US009939751B2

(12) United States Patent
Tsuchiya et al.

(10) Patent No.: US 9,939,751 B2
(45) Date of Patent: Apr. 10, 2018

(54) CHARGING DEVICE AND IMAGE FORMING APPARATUS

(71) Applicant: KYOCERA Document Solutions Inc., Osaka (JP)

(72) Inventors: Hiroaki Tsuchiya, Osaka (JP); Koichi Imanaka, Osaka (JP); Kenichi Mukai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/517,589

(22) PCT Filed: Apr. 20, 2016

(86) PCT No.: PCT/JP2016/062520
§ 371 (c)(1),
(2) Date: Apr. 7, 2017

(87) PCT Pub. No.: WO2016/203839
PCT Pub. Date: Dec. 22, 2016

(65) Prior Publication Data

US 2017/0307995 A1 Oct. 26, 2017

(30) Foreign Application Priority Data

Jun. 19, 2015 (JP) ..... 2015-124072

(51) Int. Cl.
*G03G 15/02* (2006.01)

(52) U.S. Cl.
CPC ..... *G03G 15/0225* (2013.01); *G03G 15/0233* (2013.01)

(58) Field of Classification Search
CPC ..... G03G 15/0225; G03G 15/0233
See application file for complete search history.

(56) References Cited

U.S. PATENT DOCUMENTS 8,472,839 B2 * 6/2013 Kishi ..... G03G 21/1821 399/111
2016/0378014 A1 * 12/2016 Hoshino ..... G03G 15/0283 399/89

FOREIGN PATENT DOCUMENTS

JP 11160969 A * 6/1999
JP 2007078068 A * 3/2007
JP 2012-242567 A 12/2012
JP 2013246288 A * 12/2013

* cited by examiner

*Primary Examiner* — Gregory H Curran
(74) *Attorney, Agent, or Firm* — Studebaker & Brackett PC

(57) ABSTRACT

A charging device (51) includes a charging roller (65), a supporting section (71), a guide (73), a first biasing section (75), and a second biasing section (90). The charging roller (65) charges an image bearing member (50). The supporting section (71) supports the charging roller (65) such that the charging roller (65) is rotatable. The guide (73) guides the supporting section (71) in a first direction (D1). The first biasing section (75) biases the supporting section (71) in the first direction (D1) to press the charging roller (65) against the image bearing member (50). The second biasing section (90) biases the supporting section (71 toward the guide (73).

11 Claims, 12 Drawing Sheets

CHARGING DEVICE AND IMAGE FORMING APPARATUS

TECHNICAL FIELD

The present invention relates to charging devices and image forming apparatuses.

BACKGROUND ART

A charging device including a charging roller and a cleaning member is generally known. The charging roller charges a photosensitive member. The charging roller is in contact with the photosensitive member. The charging roller may therefore be contaminated by either or both of a trace of toner left on the photosensitive member and paper dust. Accordingly, the charging roller is cleaned using the cleaning member.

For example, Patent Literature 1 discloses a charging device including a charging roller supported by a supporting member. The charging roller is pressed against a photosensitive member through a spring member biasing the supporting member. Accordingly, the charging roller passively rotates in accompaniment to rotation of the photosensitive member. In contrast, a cleaning member therein rotates through driving force of a drum gear. As a result, the charging roller is cleaned.

CITATION LIST

Patent Literature

[Patent Literature 1]
Japanese Patent Application Laid-Open Publication No. 2012-242567

SUMMARY OF INVENTION

Technical Problem

However, the cleaning member in the charging device disclosed in Patent Literature 1 may cause the supporting member to vacillate or oscillate as rotating through driving force of the drum gear. Furthermore, vacillation or oscillation of the supporting member may cause the charging roller to vacillate or oscillate. This may result in non-uniform image density in an image formed on a sheet based on an electrostatic latent image formed on the photosensitive member.

The present invention has been achieved in consideration of the above problem and an objective thereof is to provide a charging device and an image forming apparatus that are capable of reducing occurrence of non-uniform image density in an image formed on a sheet.

Solution to Problem

A charging device according to a first aspect of the present invention includes a charging roller, a supporting section, a guide, a first biasing section, and a second biasing section. The charging roller charges an image bearing member. The supporting section supports the charging roller such that the charging roller is rotatable. The guide guides the supporting section in a first direction. The first biasing section biases the supporting section in the first direction to press the charging roller against the image bearing member. The second biasing section biases the supporting section toward the guide.

An image forming apparatus according to a second aspect of the present invention forms an image on a sheet. The image forming apparatus includes the charging device according to the first aspect and the image bearing member.

Advantageous Effects of Invention

According to the present invention, it is possible to reduce occurrence of non-uniform image density in an image formed on a sheet.

DESCRIPTION OF EMBODIMENTS

Figure 1:
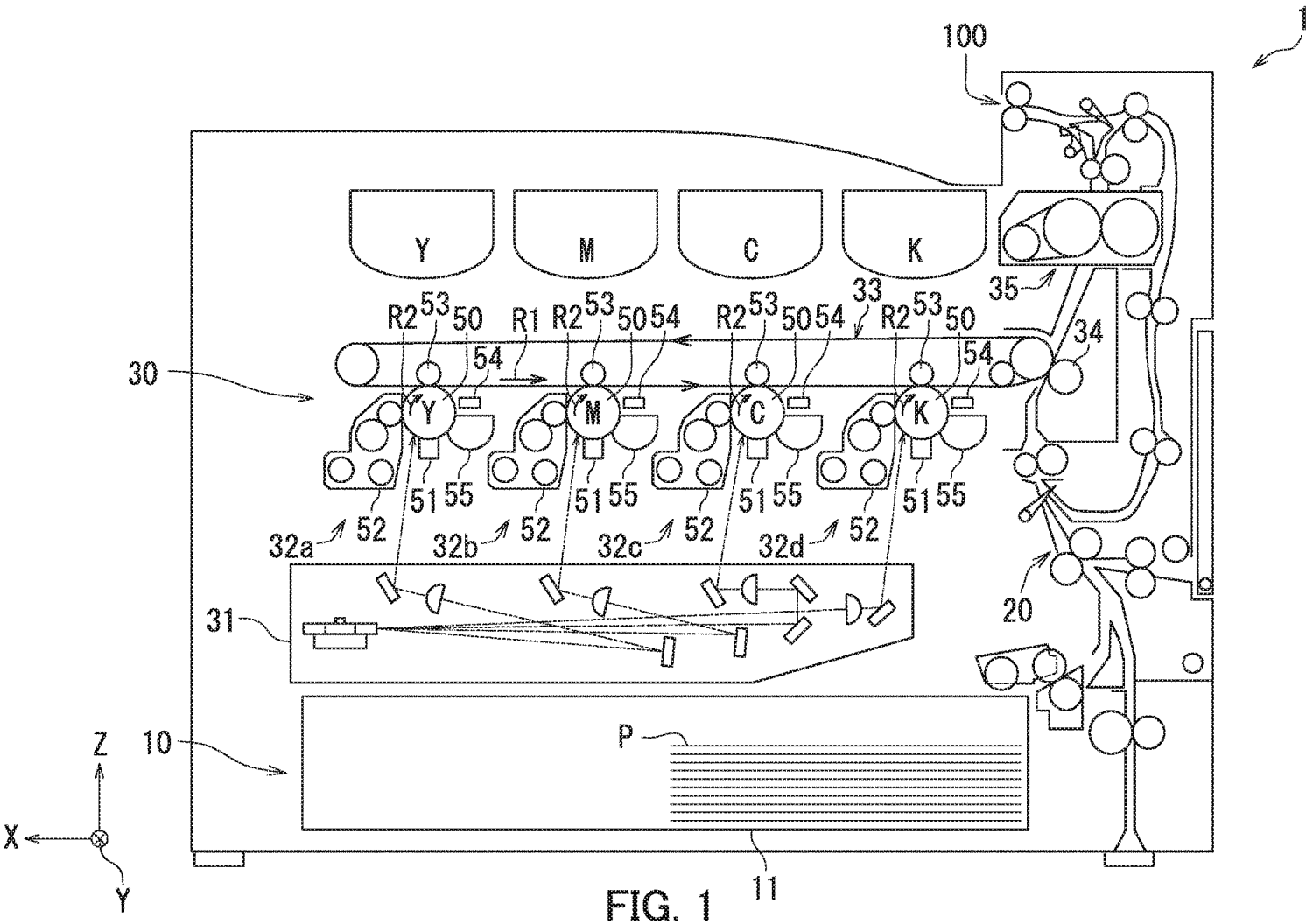
FIG. 1 is a cross-sectional view illustrating an image forming apparatus according to an embodiment of the present invention.

The following describes an embodiment of the present invention with reference to the drawings. Elements that are the same or equivalent are indicated by the same reference signs in the drawings and description thereof is not repeated.

An X axis, a Y axis, and a Z axis are perpendicular to one another with the Z axis being substantially parallel to a vertical direction and theZ axis and the Y axis being substantially parallel to a horizontal direction.

The following describes an image forming apparatus 1 according to an embodiment of the present invention with reference to FIG. 1. FIG. 1 is a cross-sectional view illustrating the image forming apparatus 1. The image forming apparatus 1 forms images on sheets P. The image forming apparatus 1 according to the present embodiment is a printer. The image forming apparatus 1 is a tandem image forming apparatus including a sheet feeding section 10, a conveyance section 20, an image forming section 30, and an ejection section 100.

The sheet feeding section 10 includes a cassette 11 in which a plurality of sheets P are loaded. The sheets P are for example paper or synthetic resin sheets. The sheet feeding section 10 feeds a sheet P from the cassette 11 to the conveyance section 20. The conveyance section 20 conveys the sheet P to the image forming section 30. The image forming section 30 forms an image on the sheet P. After the image is formed on the sheet P, the conveyance section 20 conveys the sheet P to the ejection section 100. The ejection section 100 ejects the sheet P out of the image forming apparatus 1.

The image forming section 30 includes a light exposure unit 31, a unit 32*a*, a unit 32*b*, a unit 32*c*, a unit 32*d*, an intermediate transfer belt 33, a secondary transfer roller 34, and a fixing unit 35.

The light exposure unit 31 irradiates each of the units 32*a* to 32*d* with light based on image data to form an electrostatic latent image in each of the units 32*a* to 32*d*.

The unit 32*a* forms a yellow developer image based on the electrostatic latent image. The unit 32*b* forms a magenta developer image based on the electrostatic latent image. The unit 32*c* forms a cyan developer image based on the electrostatic latent image. The unit 32*d* forms a black developer image based on the electrostatic latent image.

The intermediate transfer belt 33 rotates in a rotation direction R1. The developer images of the four colors are transferred from the units 32*a* to 32*d* onto an outer surface of the intermediate transfer belt 33 such that the developer images are superimposed on one another to form an image. The secondary transfer roller 34 transfers the image formed on the outer surface of the intermediate transfer belt 33 onto the sheet P. The fixing unit 35 applies heat and pressure on the sheet P to fix the image to the sheet P.

Each of the units 32*a* to 32*d* includes a photosensitive drum 50 (image bearing member), a charging device 51, a developing device 52, a primary transfer roller 53, a static eliminator 54, and a cleaner 55. The plurality of photosensitive drums 50 are in contact with the outer surface of the intermediate transfer belt 33 and are arranged along the rotation direction R1 of the intermediate transfer belt 33. The plurality of primary transfer rollers 53 are disposed opposite to the plurality of photosensitive drums 50 in one-to-one correspondence with the intermediate transfer belt 33 therebetween.

In each of the units 32*a* to 32*d*, the charging device 51, the developing device 52, the primary transfer roller 53, the static eliminator 54, and the cleaner 55 are arranged along a circumferential surface of the photosensitive drum 50 in the stated order.

The photosensitive drum 50 rotates in a rotation direction R2. The charging device 51 charges the circumferential surface of the photosensitive drum 50. The circumferential surface of the photosensitive drum 50 is irradiated with light by the light exposure unit 31, and thus an electrostatic latent image is formed on the circumferential surface of the photosensitive drum 50. The developing device 52 causes a developer to adhere to the electrostatic latent image to develop the electrostatic latent image. Thus, a developer image is formed on the circumferential surface of the photosensitive drum 50. That is, the photosensitive drum 50 bears the developer image thereon. The primary transfer roller 53 transfers the developer image borne by the photosensitive drum 50 to the outer surface of the intermediate transfer belt 33. The static eliminator 54 eliminates static electricity from the circumferential surface of the photosensitive drum 50. The cleaner 55 removes the developer left on the circumferential surface of the photosensitive drum 50.

Figure 2:
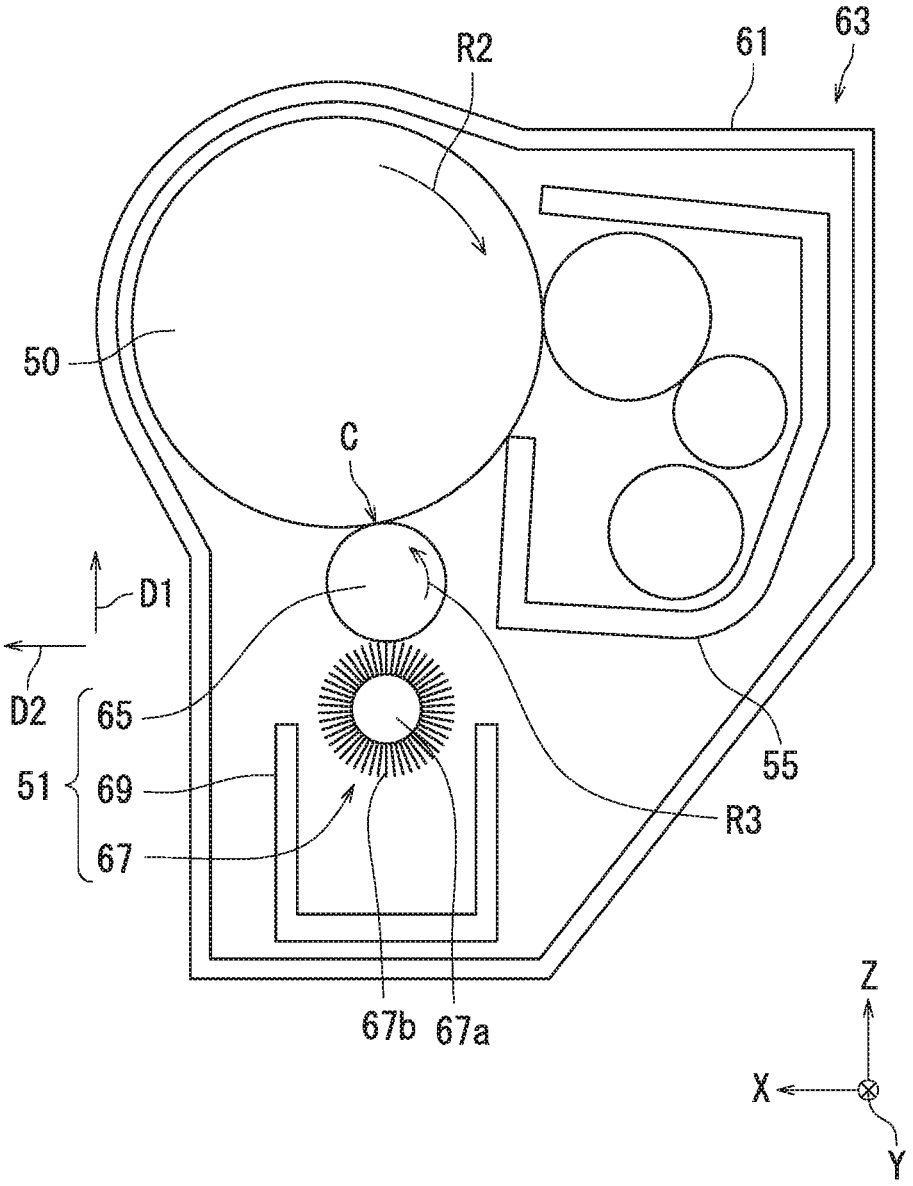
FIG. 2 is a cross-sectional view illustrating a photosensitive drum, a charging device, and a cleaner of the image forming apparatus according to the embodiment of the present invention.

The following describes the photosensitive drum 50, the charging device 51, and the cleaner 55 with reference to FIG. 2. FIG. 2 is a cross-sectional view illustrating the photosensitive drum 50, the charging device 51, and the cleaner 55. As illustrated in FIG. 2, the image forming apparatus 1 further includes housings 61. The photosensitive drum 50 is rotatably supported by a corresponding one of the housings 61. The charging device 51 and the cleaner 55 are also supported by the housing 61. The housing 61, the photosensitive drum 50, the charging device 51, and the cleaner 55 form a drum unit 63.

The charging device 51 includes a charging roller 65, a cleaning member 67, and a base member 69.

The charging roller 65 charges the photosensitive drum 50. The charging roller 65 is a conductive rubber roller including a metal core and an elastic layer such as rubber formed on a circumferential surface of the metal core. The charging roller 65 is pressed against the photosensitive drum 50. Accordingly, the charging roller 65 passively rotates in a rotation direction R3 in accompaniment to the rotation of the photosensitive drum 50. The rotation direction R3 is an opposite direction to the rotation direction R2.

The cleaning member 67 cleans the charging roller 65. The cleaning member 67 is in contact with the charging roller 65. The cleaning member 67 is driven by a drive mechanism. More specifically, the drive mechanism causes rotation of the cleaning member 67 while causing reciprocation of the cleaning member 67 along an axial direction of the cleaning member 67. As a result, the cleaning member 67 removes matters (for example, either or both of developer and paper dust) adhering to the charging roller 65. The cleaning member 67 according to the present embodiment is a brush roller including a solid cylindrical or hollow cylindrical body 67*a* and a brush 67*b*. The brush 67*b* has a specific bristle density and is radially disposed on a circumferential surface of the body 67*a*.

The base member 69 has a substantially U-shaped cross-section and is formed from an electrically insulating resin. The base member 69 extends along the axial direction of the cleaning member 67 and accommodates a portion of the cleaning member 67.

Figure 3:
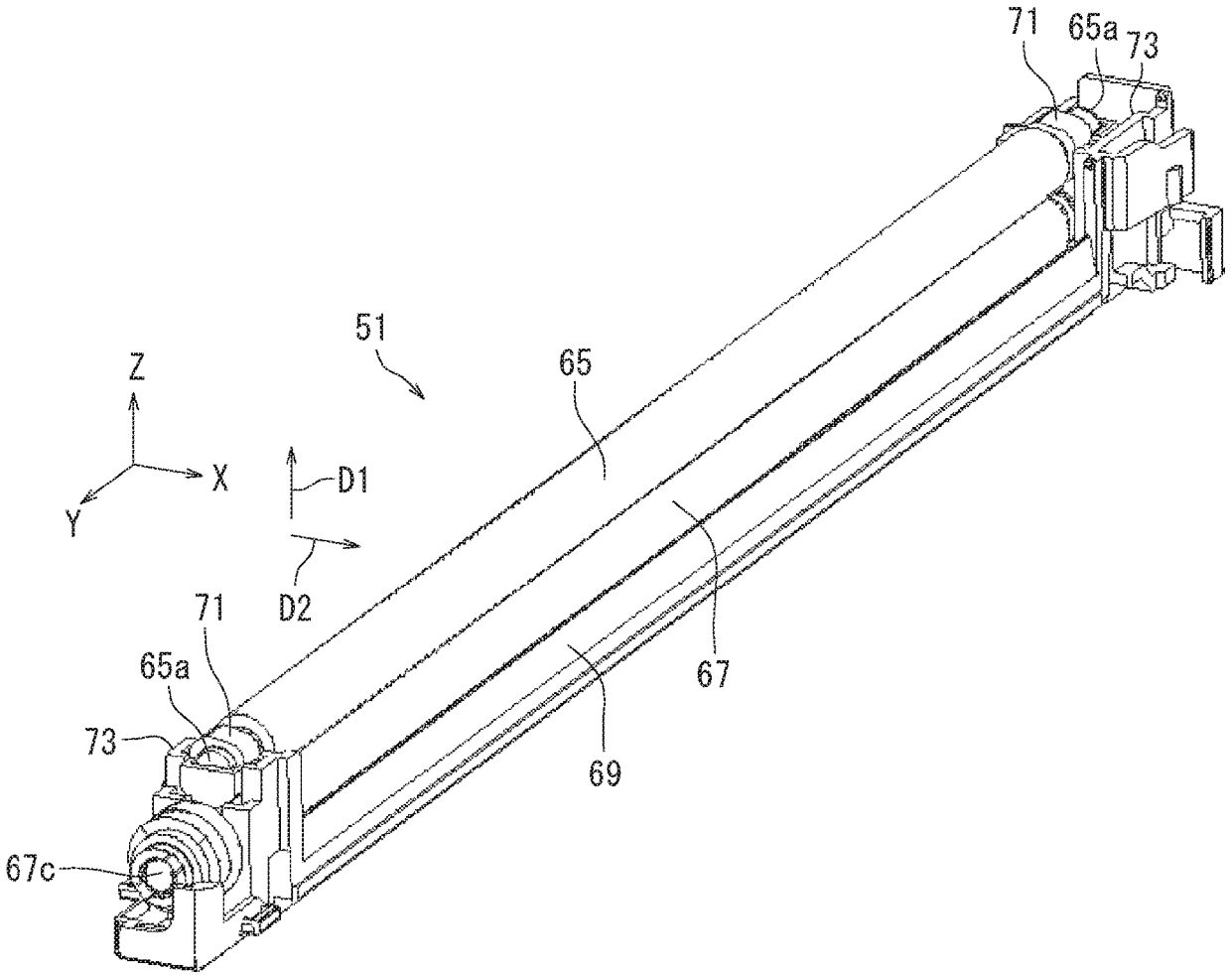
FIG. 3 is a perspective view illustrating the charging device of the image forming apparatus according to the embodiment of the present invention.
Figure 4:
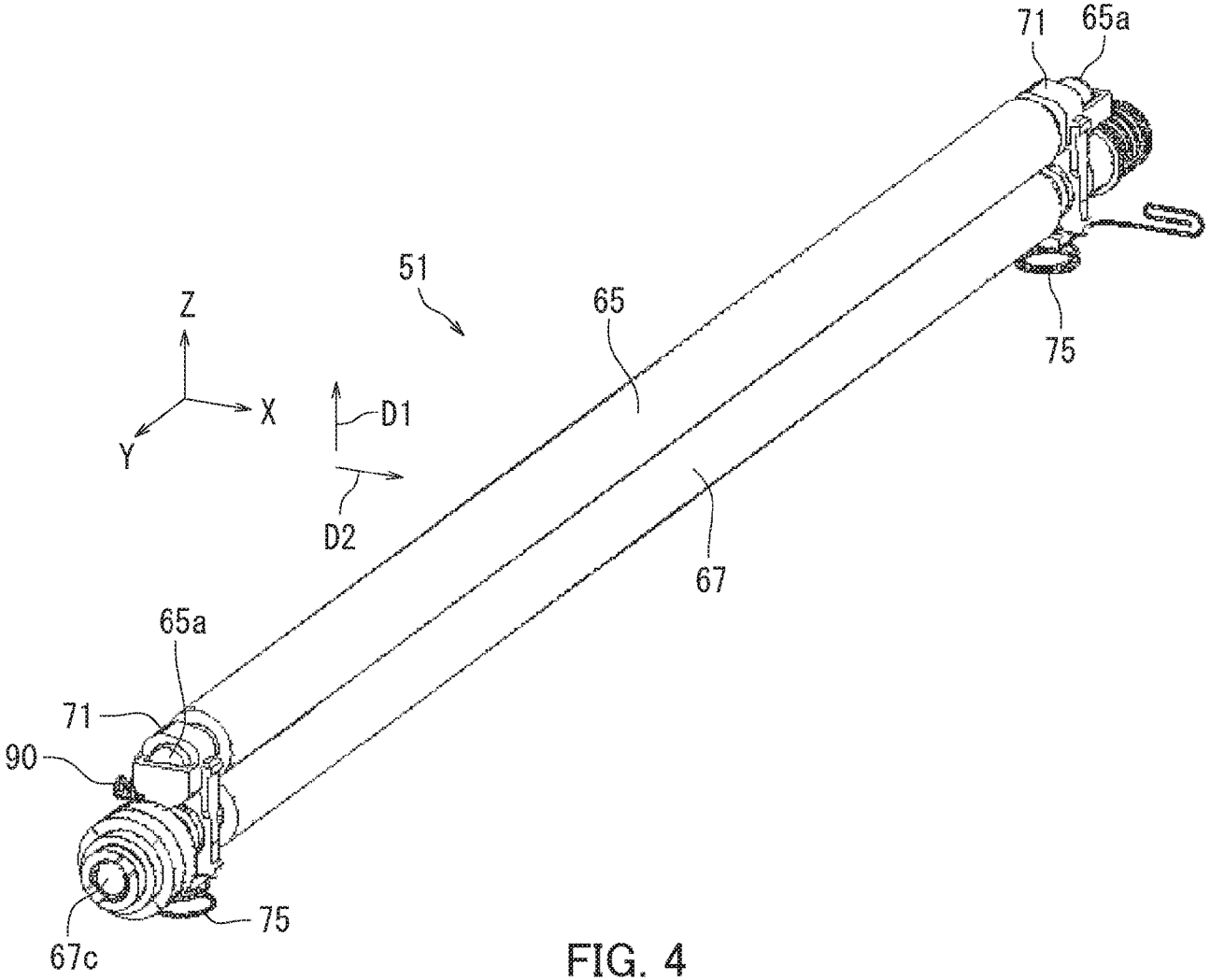
FIG. 4 is a perspective view illustrating the charging device of the image forming apparatus according to the embodiment of the present invention from which a base member of the charging device has been detached.

The following describes the charging device 51 with reference to FIGS. 3 and 4. FIGS. 3 and 4 are perspective views illustrating the charging device 51. FIG. 4 illustrates the charging device 51 from which the base member 69 has been detached.

As illustrated in FIGS. 3 and 4, the charging device 51 further includes a pair of supporting members 71 (supporting section), a pair of guides 73, a pair of first coil springs 75 (a pair of first biasing sections), and a pair of second coil springs 90 (a pair of second biasing sections). The charging roller 65 includes a pair of shafts 65*a*. The pair of shafts 65*a* are located on opposite axial ends of the charging roller 65.

The cleaning member 67 further includes a pair of shafts 67*c*. The pair of shafts 67*c* are located on opposite axial ends of the cleaning member 67.

The pair of supporting members 71 respectively support the pair of shafts 65*a* of the charging roller 65 such that the charging roller 65 is rotatable. The pair of supporting members 71 respectively support the pair of shafts 67*c* of the cleaning member 67 such that the cleaning member 67 is rotatable. The supporting members 71 are formed from a synthetic resin (for example, polycarbonate).

One of the pair of supporting members 71 is located at one of the axial ends of the charging roller 65 and one of the axial ends of the cleaning member 67. The other supporting member 71 is located at the other of the axial ends of the charging roller 65 and the other of the axial ends of the cleaning member 67.

The pair of guides 73 are located at opposite longitudinal ends of the base member 69 in one-to-one correspondence with the pair of supporting members 71. In the present embodiment, the pair of guides 73 are integral with the base member 69. The supporting members 71 are slidably mounted in the guides 73. The guides 73 guide the supporting members 71 in a first direction D1. In the present embodiment, the first direction D1 is a direction toward a positive direction of the Z axis.

The pair of first coil springs 75 respectively bias the pair of supporting members 71 in the first direction D1 to press the charging roller 65 against the photosensitive drum 50. The first coil springs 75 have a substantially frustoconical shape.

The pair of second coil springs 90 are respectively disposed on the pair of supporting members 71. The second coil springs 90 bias the supporting members 71 toward the guides 73. Thus, the supporting members 71 are pressed against the guides 73, restricting vacillation and oscillation of the supporting members 71. Through restriction of vacillation and oscillation of the supporting members 71, vacillation and oscillation of the charging roller 65 can be restricted.

As a result, the present embodiment can reduce occurrence of non-uniform image density in an image formed on a sheet P based on an electrostatic latent image formed on the photosensitive drum 50.

More specifically, the second coil springs 90 bias the supporting members 71 in a second direction D2 to press the supporting member 71 against the guides 73. The second direction D2 is substantially perpendicular to the first direction D1. Accordingly, the biasing force of the second coil springs 90 does not increase the pressing force applied from the charging roller 65 to the photosensitive drum 50. As a result, according to the present embodiment, the photosensitive drum 50 can rotate smoothly, and the quality of an image that is formed on a sheet P can be improved.

The biasing force of the first coil springs 75 in the first direction D1 is for example set to 5 newtons, and the biasing force of the second coil springs 90 in the second direction D2 is for example set to 1.5 newtons. In such a configuration, the biasing force of the second coil springs 90 does not increase the pressing force applied from the charging roller 65 to the photosensitive drum 50. That is, the biasing force of the second coil springs 90 in the second direction D2 is smaller than the biasing force of the first coil springs 75 in the first direction D1, and therefore the pressing force from the charging roller 65 to the photosensitive drum 50 can be further restricted from increasing because of the second coil springs 90. As a result, according to the present embodiment, the photosensitive drum 50 can rotate more smoothly, and the quality of an image that is formed on a sheet P can be further improved.

In the present embodiment, the second direction D2 is a direction toward a positive direction of the Z axis. The second coil springs 90 have a substantially hollow cylindrical shape. Furthermore, FIG. 4 shows one of the pair of second coil springs 90.

Figure 5:
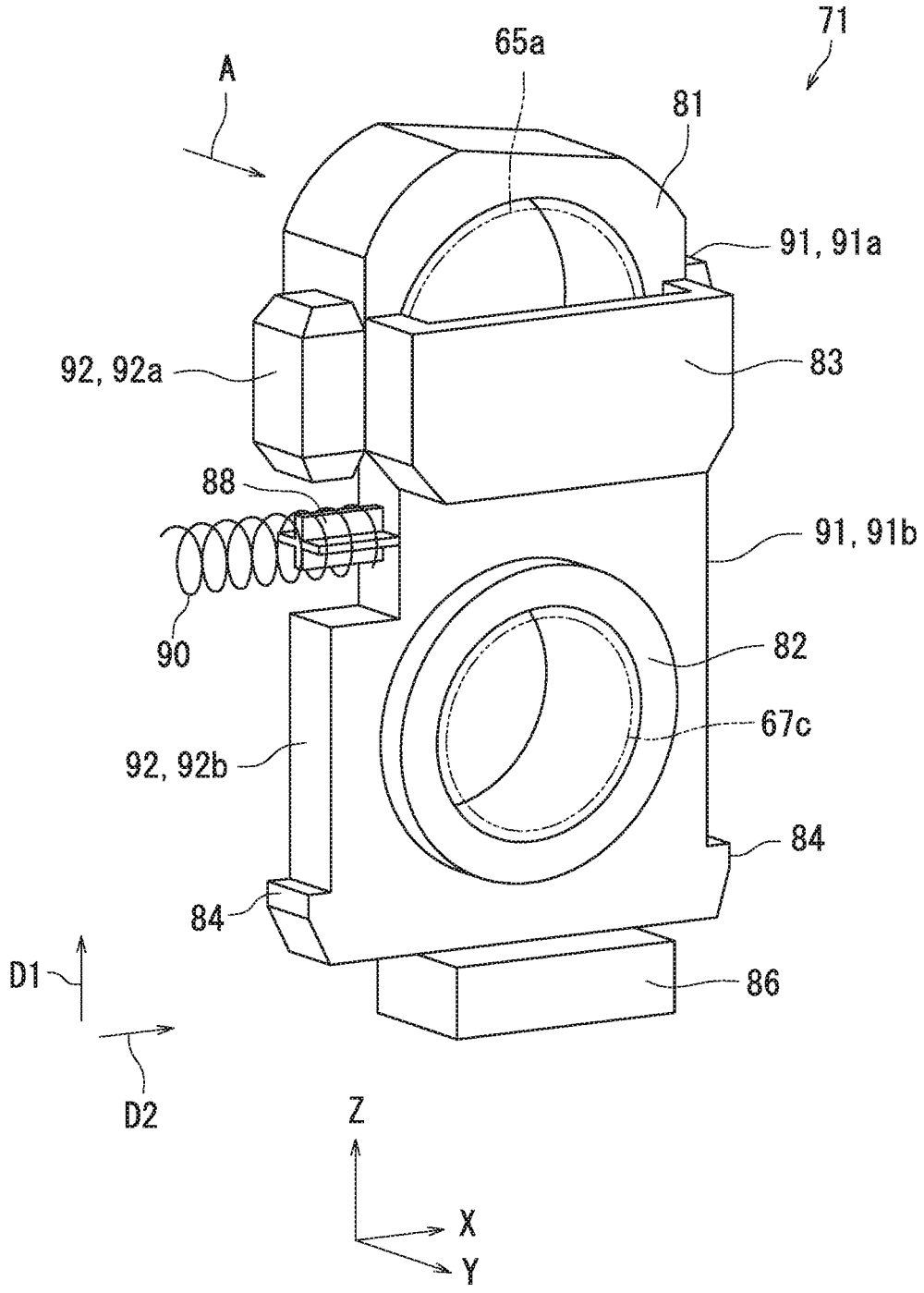
FIG. 5 is a perspective view illustrating a supporting member included in the charging device of the image forming apparatus according to the embodiment of the present invention.
Figure 6:
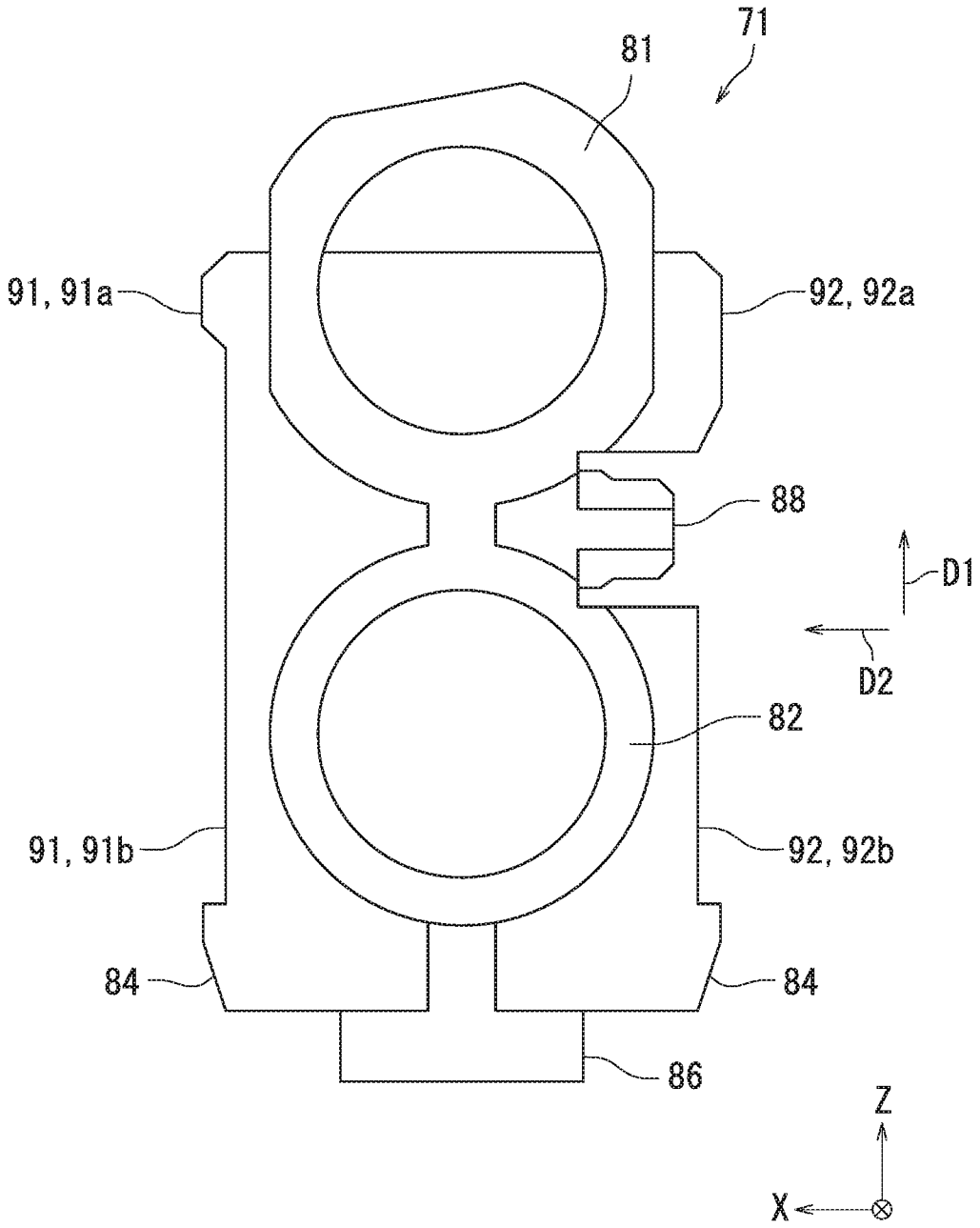
FIG. 6 is a back view illustrating the supporting member included in the charging device of the image forming apparatus according to the embodiment of the present invention.
Figure 7:
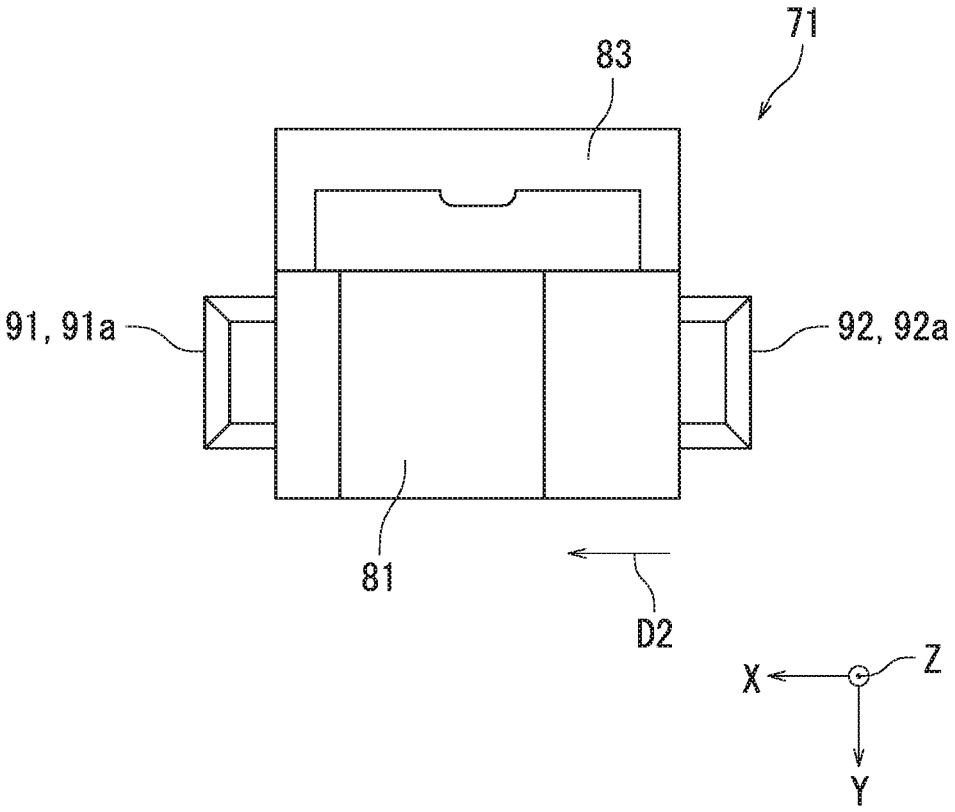
FIG. 7 is a plan view illustrating the supporting member included in the charging device of the image forming apparatus according to the embodiment of the present invention.
Figure 8:
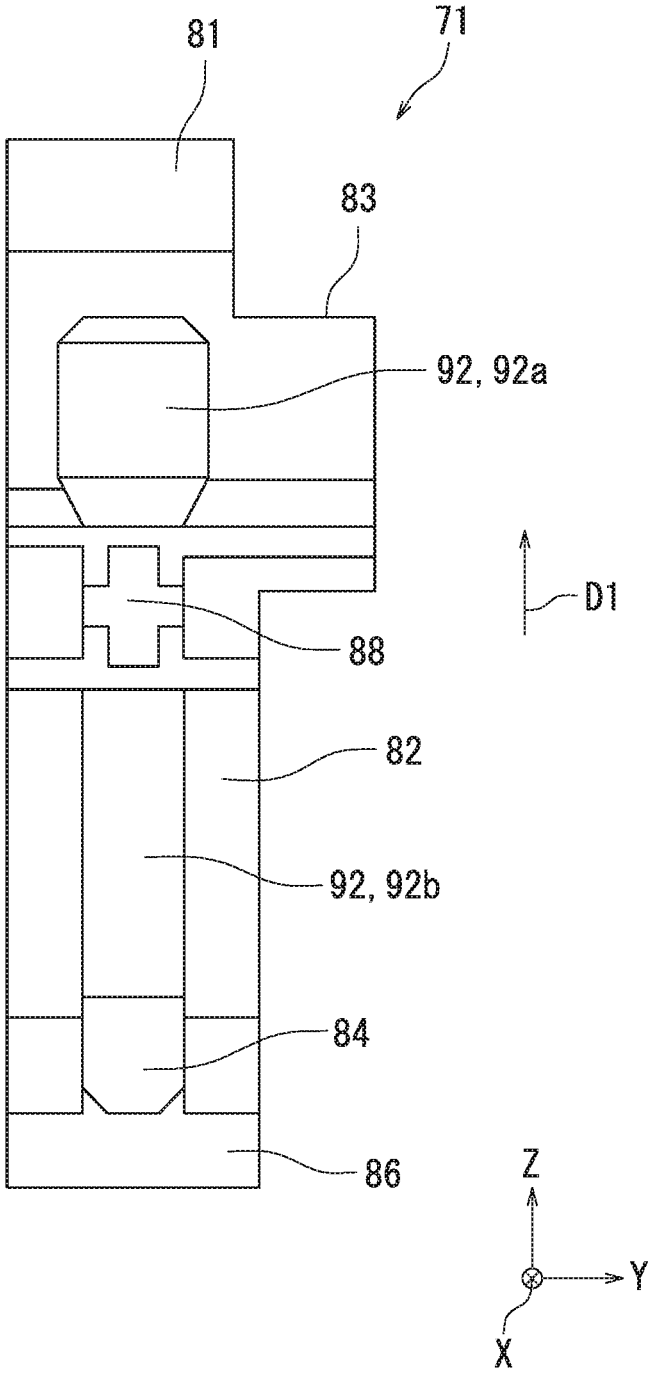
FIG. 8 is a side view illustrating the supporting member included in the charging device of the image forming apparatus according to the embodiment of the present invention.

The following describes the supporting members 71 with reference to FIGS. 5 to 8. FIG. 5 is a perspective view illustrating one supporting member 71. FIG. 6 is a back view illustrating the supporting member 71. FIG. 6 is a view of the supporting member 71 from a direction A in FIG. 5. FIG. 7 is a plan view illustrating the supporting member 71. FIG. 8 is a side view illustrating the supporting member 71.

As illustrated in FIGS. 5 to 8, each of the supporting members 71 includes a first bearing section 81, a second bearing section 82, a restriction section 83, a plurality of stoppers 84, a mount section 86, an attachment section 88, a plurality of first guided sections 91, and a plurality of second guided sections 92.

The first bearing section 81 rotatably supports one of the shafts 65*a* of the charging roller 65. The restriction section 83 is located opposite to a portion of an end surface of the shaft 65*a*. The restriction section 83 restricts movement of the charging roller 65 in an axial direction of the charging roller 65. As a result, the charging roller 65 is prevented from becoming offset from the photosensitive drum 50. The second bearing section 82 rotatably supports one of the shafts 67*c* of the cleaning member 67.

The two first guided sections 91 are elongated along the first direction D1. One first guided section 91 (hereinafter, may be referred to as "a first guided section 91*a*") of the two first guided sections 91 is located adjacent to the first bearing section 81. The other first guided section 91 (hereinafter, may be referred to as "a first guided section 91*b*") is located adjacent to the second bearing section 82. The first guided section 91*a* protrudes further toward the outside of the supporting member 71 than the first guided section 91*b*. The first guided sections may include a plurality of the first guided sections 91*a* or a plurality of the first guided sections 91*b*.

The two second guided sections 92 are elongated along the first direction D1. One second guided section 92 (hereinafter, may be referred to as "a second guided section 92*a*") of the two second guided sections 92 is located adjacent to the first bearing section 81. The other second guided section 92 (hereinafter, may be referred to as "a second guided section 92*b*") is located adjacent to the second bearing section 82. The second guided section 92*a* protrudes further toward the outside of the supporting member 71 than the second guided section 92*b*. The second guided sections may include a plurality of the second guided sections 92*a* or a plurality of the second guided sections 92*b*.

A proximal section of the second coil spring 90 is mounted on the attachment section 88. As a result, the second coil spring 90 is installed on the attachment section 88.

More specifically, the attachment section 88 is located between the second guided section 92*a* and the second guided section 92*b*. The attachment section 88 protrudes toward the outside of the supporting member 71 from the location between the second guided section 92*a* and the second guided section 92*b*. However, the attachment section 88 does not protrude further outward than the second guided section 92*a* and the second guided section 92*b*. That is, a distal end of the attachment section 88 is located inward of the second guided section 92*a* and the second guided section 92*b*. The attachment section 88 is a protrusion having a substantially cross-shaped cross-section. The proximal section of the second coil spring 90 is disposed around the attachment section 88.

One stopper 84 of the two stoppers 84 is located at one end of opposite ends of the first guided section 91*b* that is farther from the first guided section 91*a*. The one stopper 84 protrudes further toward the outside of the supporting member 71 than the first guided section 91*b*. The other stopper 84 is located at one end of opposite ends of the second guided section 92*b* that is farther from the second guided section 92*a*. The other stopper 84 protrudes further toward the outside of the supporting member 71 than the second guided section 92*b*.

The mount section 86 has a substantially plate-like shape. The mount section 86 is included in the supporting member 71 at a position that allows the second bearing section 82 to be located between the mount section 86 and the first bearing section 81.

Figure 9:
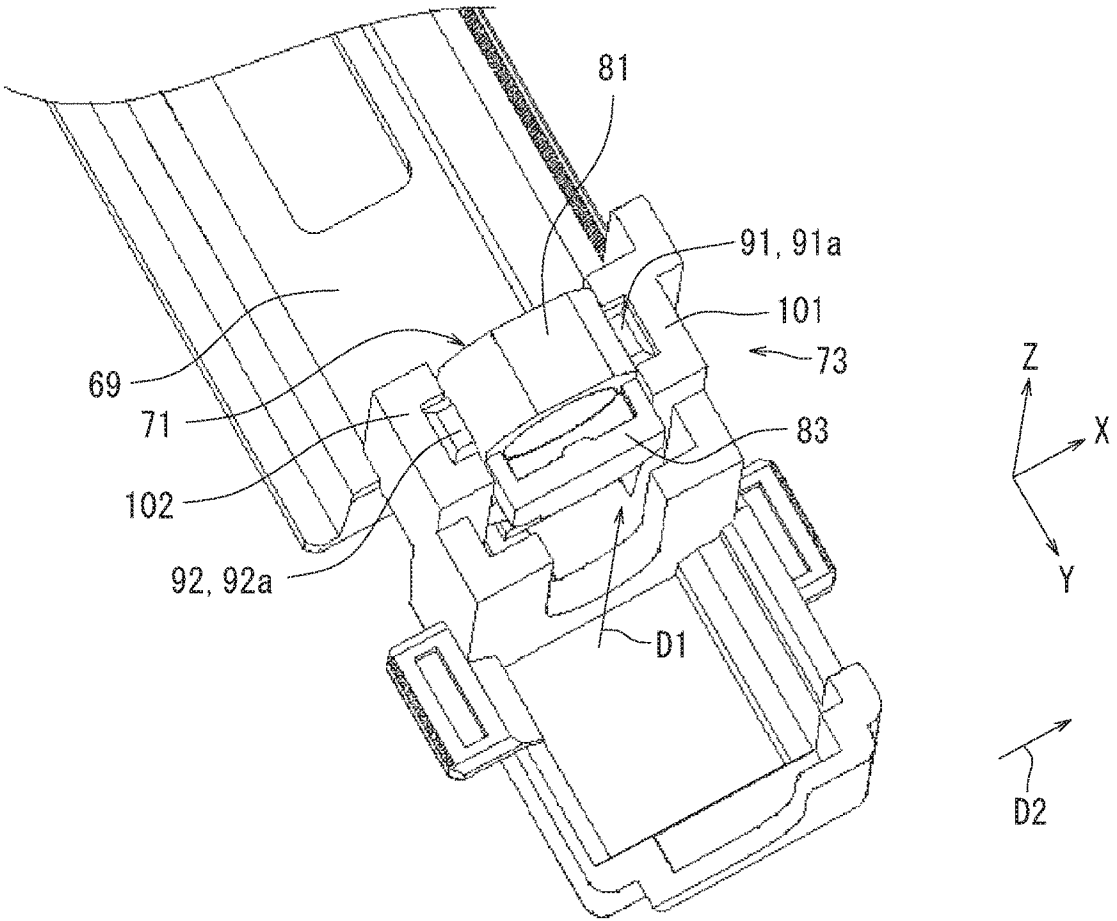
FIG. 9 is a perspective view illustrating a guide and the supporting member included in the charging device of the image forming apparatus according to the embodiment of the present invention.
Figure 10:
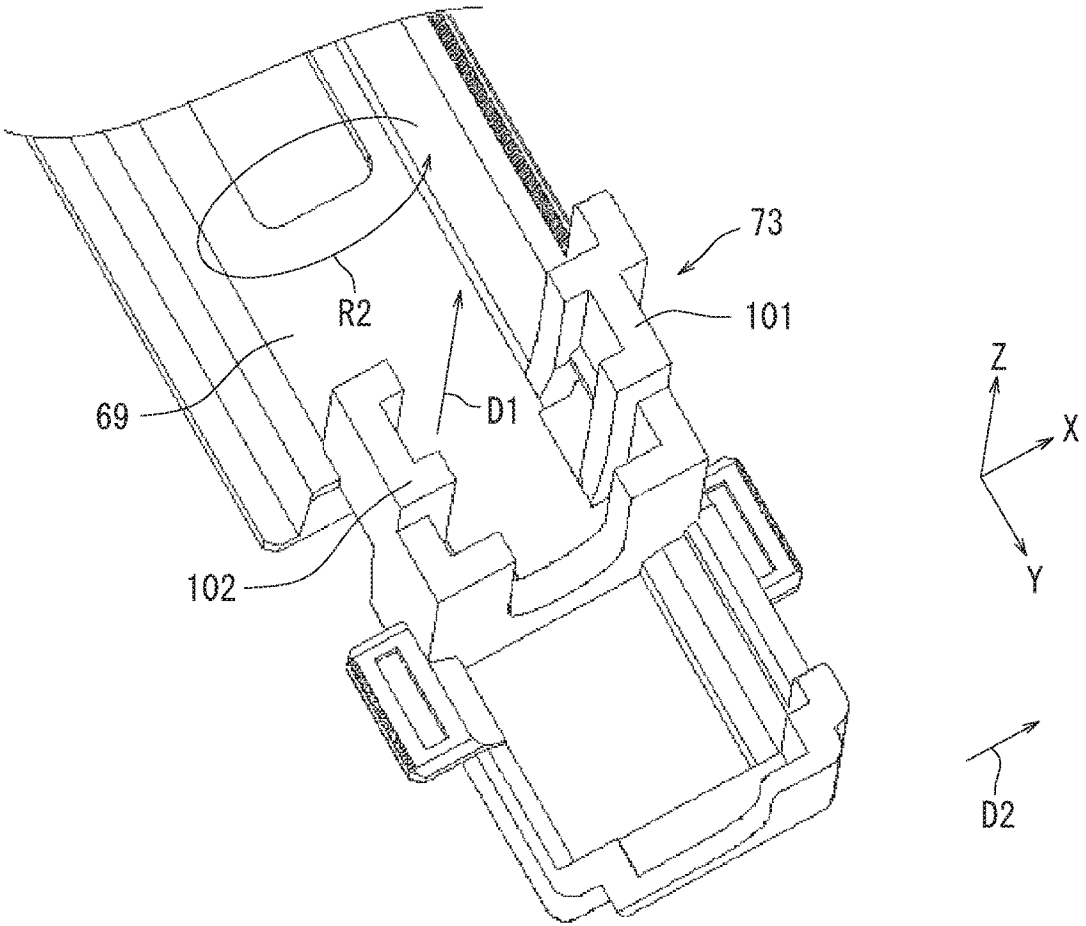
FIG. 10 is a perspective view illustrating the guide included in the charging device of the image forming apparatus according to the embodiment of the present invention.

The following describes the guides 73 with reference to FIGS. 2, 9, and 10. FIG. 9 is a perspective view illustrating one guide 73 and one supporting member 71. FIG. 10 is a perspective view illustrating the guide 73.

As illustrated in FIGS. 9 and 10, each of the guides 73 includes a first guiding section 101 and a second guiding section 102. The first guiding section 101 has a substantially U-shaped cross-section and is elongated along the first direction D1. A corresponding one of the first guided sections 91 of the supporting member 71 engages with (for example, loosely fits into) the first guiding section 101. Likewise, the second guiding section 102 has a substantially U-shaped cross-section and is elongated along the first direction D1. A corresponding one of the second guided sections 92 of the supporting member 71 engages with (for example, loosely fits into) the second guiding section 102.

With the first guided section 91 and the second guided section 92 respectively in engagement with the first guiding section 101 and the second guiding section 102, the supporting member 71 is slidable in the first direction D1 along the first guiding section 101 and the second guiding section 102. That is, the first guiding section 101 and the second guiding section 102 guide the supporting member 71 in the first direction D1. Note that the supporting member 71 is also slidable in an opposite direction to the first direction D1.

The first guiding section 101 and the second guiding section 102 are located opposite to one another. As illustrated in FIGS. 2, 9, and 10, the first guiding section 101 is located downstream of the second guiding section 102 in the rotation direction R2 of the photosensitive drum 50. More specifically, the first guiding section 101 is located downstream of the second guiding section 102 in the rotation direction R2 at a contact position C between the photosensitive drum 50 and the charging roller 65.

Figure 11:
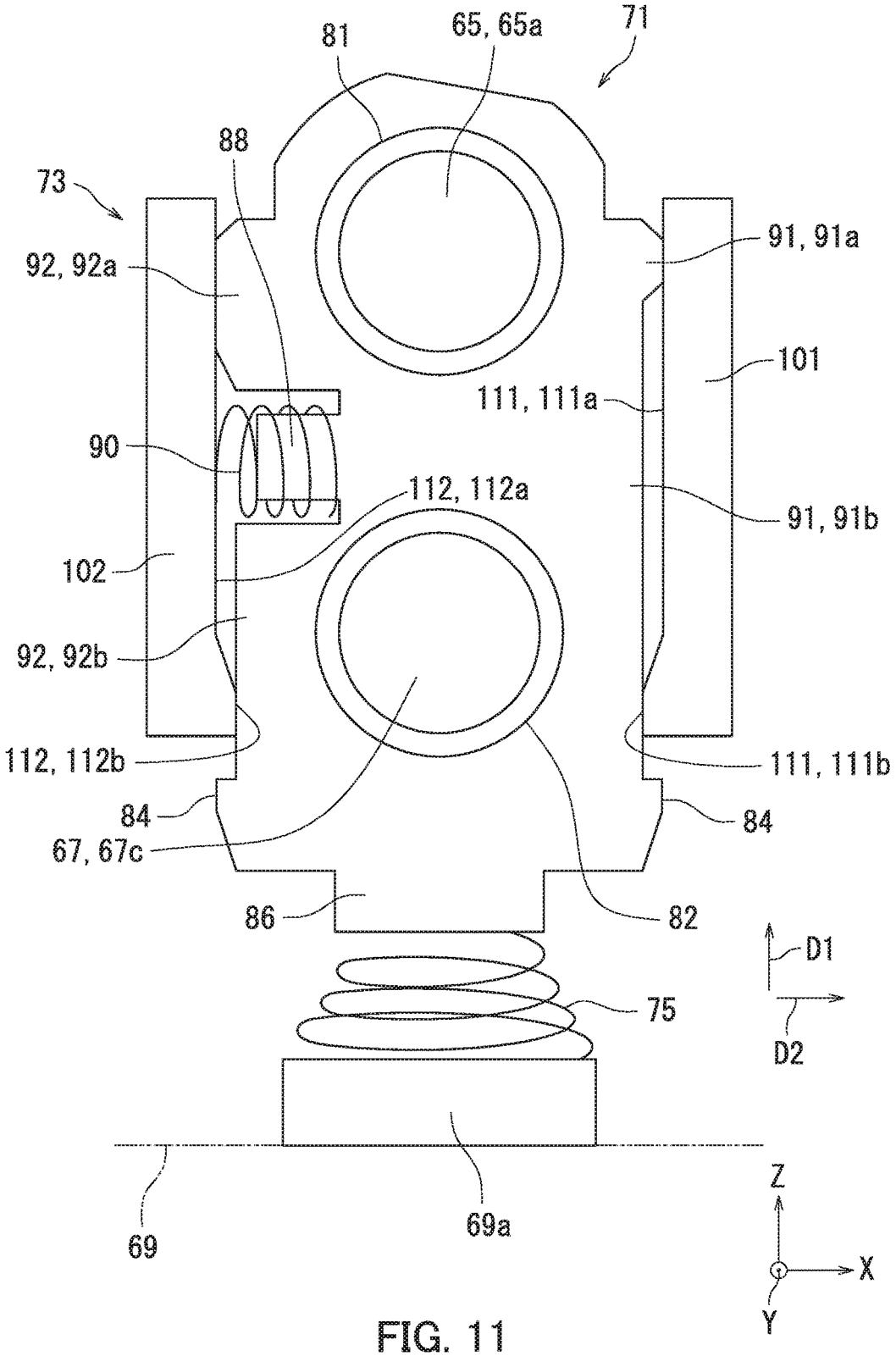
FIG. 11 is a cross-sectional view illustrating the supporting member, the guide, a first coil spring, and a second coil spring included in the charging device of the image forming apparatus according to the embodiment of the present invention.

The following describes the first coil springs 75 and the second coil springs 90 with reference to FIG. 11. FIG. 11 is a cross-sectional view illustrating one supporting member 71, one guide 73, one first coil spring 75, and one second coil spring 90. In FIG. 11, a gap (hereinafter, referred to as "a gap G") between the supporting member 71 and the guide 73 that is necessary for the supporting member 71 to slide along the guide 73 is not shown in the interest of ease of illustration.

As illustrated in FIG. 11, the base member 69 includes a base section 69*a*. A large-diameter section of the first coil spring 75 is in contact with the base section 69*a* of the base member 69. Thus, the first coil spring 75 can be disposed in a stable manner. A small-diameter section of the first coil spring 75 is in contact with the mount section 86 of the supporting member 71. The first coil spring 75 biases the supporting member 71 in the first direction D1. As a result, the supporting member 71 slides in the first direction D1 along the guide 73, and the charging roller 65 is pressed against the photosensitive drum 50 (FIG. 2). However, sliding of the supporting member 71 in the first direction D1 is restricted by the stoppers 84. More specifically, the pair of stoppers 84 respectively abut the first guiding section 101 and the second guiding section 102 to restrict sliding of the supporting member 71 in the first direction D1. As a result, the present embodiment can prevent application of excessive pressure from the charging roller 65 to the photosensitive drum 50 and allow the photosensitive drum 50 to rotate smoothly.

A distal section of the second coil spring 90 is in contact with the second guiding section 102. The second coil spring 90 biases the supporting member 71 toward the first guiding section 101. Thus, the supporting member 71 is pressed against the first guiding section 101.

As a result, the present embodiment can restrict the supporting member 71 from vacillating and oscillating in the gap G while the supporting member 71 is mounted in the guide 73. That is, rattling of the supporting member 71 in the gap G can be restricted. Through restriction of vacillation and oscillation of the supporting members 71, vacillation and oscillation of the charging roller 65 can be restricted. As a result, it is possible to reduce occurrence of non-uniform image density in an image formed on a sheet P based on an electrostatic latent image formed on the photosensitive drum 50.

More specifically, the second coil spring 90 biases the supporting member 71 in the second direction D2 toward the first guiding section 101. The second direction D2 is substantially perpendicular to the first direction D1. Therefore, according to the present embodiment, the biasing force of the second coil spring 90 does not increase the pressing force applied from the charging roller 65 to the photosensitive drum 50. As a result, the photosensitive drum 50 can rotate smoothly, and the quality of an image that is formed on a sheet P can be improved.

Furthermore, according to the present embodiment, the attachment section 88 is located between the second guided section 92*a* and the second guided section 92*b*. The second coil spring 90 is disposed between the attachment section 88 and the second guiding section 102. Accordingly, the supporting member 71 can be readily biased by the second coil spring 90 toward the first guiding section 101.

Furthermore, according to the present embodiment, the first guiding section 101 is located downstream of the second guiding section 102 in the rotation direction R2 of the photosensitive drum 50 as illustrated in FIGS. 10 and 11. The second coil spring 90 biases the supporting member 71 toward the first guiding section 101. That is, the direction in which the second coil spring 90 biases the supporting member 71 (i.e., the second direction D2) is substantially the same as the rotation direction R2 at the contact position C (FIG. 2) between the photosensitive drum 50 and the charging roller 65. Thus, influence of the biasing force of the second coil spring 90 on the rotation of the photosensitive drum 50 can be reduced. As a result, the quality of an image formed on a sheet P can be further improved.

The following describes the supporting member 71 and the guide 73 in more detail with reference to FIG. 11. As illustrated in FIG. 11, the first guided section 91*a* of the supporting member 71 protrudes further toward the first guiding section 101 than the first guided section 91*b*. Thus, the first guided section 91*a* and the first guided section 91*b* form a step.

The second guided section 92*a* of the supporting member 71 protrudes further toward the second guiding section 102 than the second guided section 92*b*. Thus, the second guided section 92*a* and the second guided section 92*b* form a step.

The first guiding section 101 of the guide 73 includes a plurality of first flat sections 111. The two first flat sections 111 are elongated along the first direction D1. One first flat section 111 (hereinafter, may be referred to as "a first flat section 111*a*") of the two first flat sections 111 is located opposite to the first guided section 91*a*. The other first flat section 111 (hereinafter, may be referred to as "a first flat section 111*b*") is located opposite to the first guided section 91*b*.

The first flat section 111*b* protrudes further toward the supporting member 71 than the first flat section 111*a*. Thus, the first flat section 111*b* and the first flat section 111*a* form a step. As a result, an area of contact between the first guided section 91*a* and the first flat section 111*a* is smaller and an area of contact between the first guided section 91*b* and the first flat section 111*b* is smaller than in a configuration including no such a step.

The second guiding section 102 of the guide 73 includes a plurality of second flat sections 112. The two second flat sections 112 are elongated along the first direction D1. One second guiding section 112 (hereinafter, may be referred to as "a second flat section 112*a*") of the two second flat sections 112 is located opposite to the second guided section 92*a*. The other second flat section 112 (hereinafter, may be referred to as "a second flat section 112*b*") is located opposite to the second guided section 92*b*.

The second flat section 112*b* protrudes further toward the supporting member 71 than the second flat section 112*a*. Thus, the second flat section 112*b* and the second flat section 112*a* form a step. As a result, an area of contact between the second guided section 92*a* and the second flat section 112*a* is smaller and an area of contact between the second guided section 92*b* and the second flat section 112*b* is smaller than in a configuration including no such a step.

According to the present embodiment, as described above with reference to FIG. 11, friction between the guide 73 and the supporting member 71 can be reduced by reducing the area of contact between the guide 73 and the supporting member 71. Such a configuration allows the supporting member 71 to slide along the guide 73 smoothly.

Furthermore, according to the present embodiment, the distal end of the attachment section 88 is located inward of the second guided section 92*a* and the second guided section 92*b*. Thus, friction between the second guiding section 102 and the supporting member 71 can be further reduced. Such a configuration allows the supporting member 71 to slide along the guide 73 more smoothly.

Note that in the present embodiment, the pair of supporting members 71 have the same configuration as one another, the pair of guides 73 have the same configuration as one another, and each of the pair of supporting members 71 is provided with the second coil spring 90. However, only one of the pair of supporting members 71 may be provided with the second coil spring 90.

Figure 12:
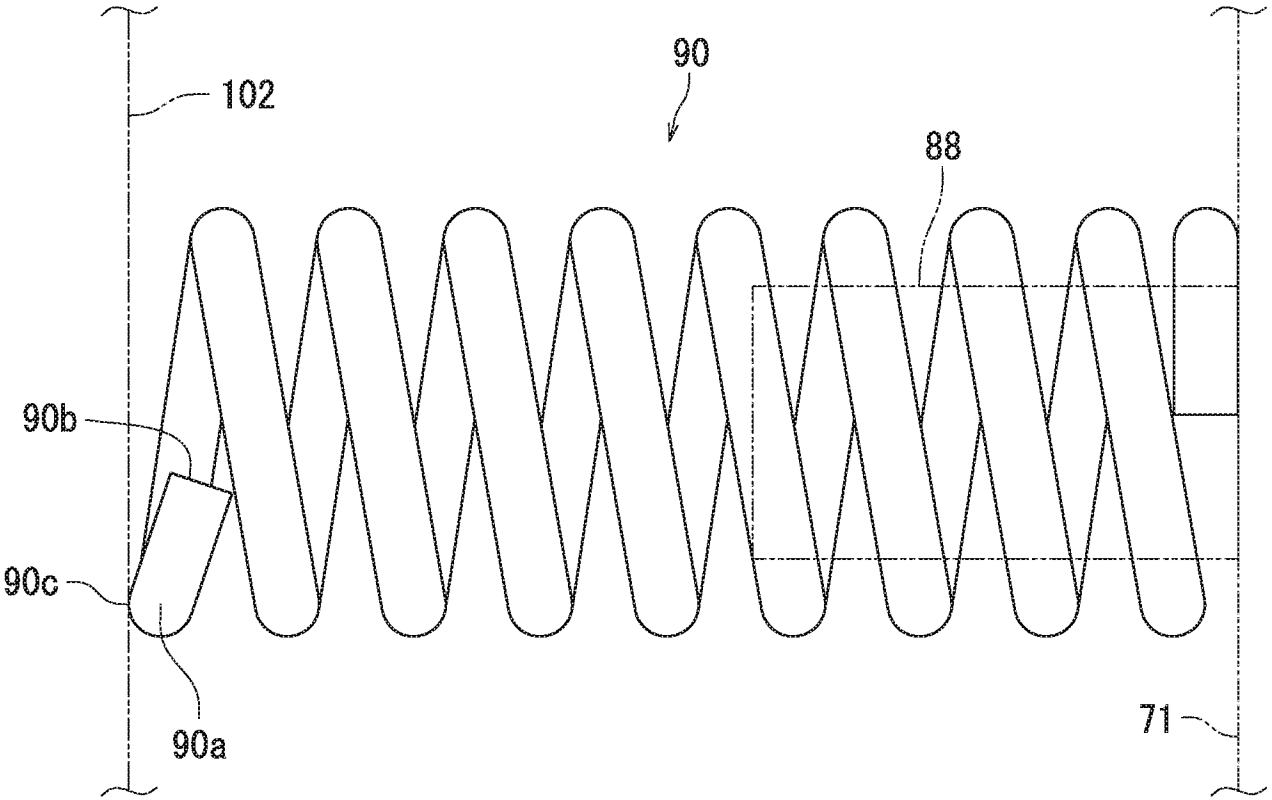
FIG. 12 is a diagram illustrating the second coil spring included in the charging device of the image forming apparatus according to the embodiment of the present invention.

The following describes the second coil springs 90 in more detail with reference to FIG. 12. FIG. 12 is a diagram illustrating one second coil spring 90. As illustrated in FIG. 12, a distal section 90*a* of the second coil spring 90 is in contact with the second guiding section 102. The distal section 90*a* bends such that an end 90*b* of the distal section 90*a* is directed toward the attachment section 88.

Thus, according to the present embodiment, the end 90*b* of the distal section 90*a* is prevented from coming in contact with the second guiding section 102. That is, a curved surface 90*c* of the distal section 90*a* is in contact with the second guiding section 102. Such a configuration allows the supporting member 71 to slide along the guide 73 more smoothly.

An embodiment of the present invention has been described above with reference to the drawings. However, the present invention is not limited to the above embodiment and may be implemented in various different forms that do not deviate from the essence of the present invention. Also, a plurality of elements of configuration disclosed in the above embodiment can be combined as appropriate to form various inventions. For example, some of the elements of configuration included in the embodiment may be omitted. Furthermore, elements of configuration included in different embodiments may be combined as appropriate. The drawings schematically illustrate elements of configuration in order to facilitate understanding and properties of elements of configuration illustrated in the drawings, such as thickness, length, quantity, and spacing, may differ from actual properties thereof in order to facilitate preparation of the drawings. Furthermore, properties of elements of configuration described in the above embodiment, such as material properties, shapes, and dimensions, are merely examples and are not intended as specific limitations. Various alterations may be made so long as there is no substantial deviation from the effects of the present invention.

INDUSTRIAL APPLICABILITY

The present invention relates to charging devices and image forming apparatuses, and is industrially applicable thereto.

The invention claimed is:

1. A charging device comprising:

a charging roller configured to charge an image bearing member;

a supporting section configured to support the charging roller such that the charging roller is rotatable;

a guide configured to guide the supporting section in a first direction;

a first biasing section configured to bias the supporting section in the first direction to press the charging roller against the image bearing member; and a second biasing section configured to bias the supporting section toward the guide.

2. The charging device according to claim 1, wherein the second biasing section biases the supporting section in a second direction perpendicular to the first direction to press the supporting section against the guide.

3. The charging device according to claim 2, wherein biasing force of the second biasing section in the second direction is smaller than biasing force of the first biasing section in the first direction.

4. The charging device according to claim 1, wherein the guide includes a first guiding section elongated along the first direction and a second guiding section elongated along the first direction, the supporting section includes a first guided section configured to engage with the first guiding section and a second guided section configured to engage with the second guiding section, the second biasing section biases the supporting section toward the first guiding section, and the first guiding section is located downstream of the second guiding section in a rotation direction of the image bearing member.

5. The charging device according to claim 1, wherein the guide includes a first guiding section elongated along the first direction and a second guiding section elongated along the first direction, the supporting section includes:

a first guided section configured to engage with the first guiding section;

a plurality of second guided sections configured to engage with the second guiding section; and an attachment section configured to receive mounting of the second biasing section, the second biasing section biases the supporting section toward the first guiding section, and the attachment section is located between one second guided section and another second guided section of the plurality of second guided sections.

6. The charging device according to claim 5, wherein the second biasing section comprises a coil spring, a proximal section of the coil spring is mounted on the attachment section, a distal section of the coil spring is in contact with the second guiding section, and the distal section of the coil spring bends such that an end of the distal section is directed toward the attachment section.

7. The charging device according to claim 6, wherein a curved surface of the distal section of the coil spring is in contact with the second guiding section.

8. The charging device according to claim 5, wherein the attachment section protrudes toward an outside of the supporting section from a location between the one second guided section and the other second guided section, and a distal end of the attachment section is located inward of the plurality of second guided sections.

9. The charging device according to claim 1, further comprising a cleaning member configured to clean the charging roller, wherein the supporting section supports the cleaning member such that the cleaning member is rotatable.

10. The charging device according to claim 9, further comprising a base member configured to accommodate a portion of the cleaning member, wherein the base member includes a base section, the supporting section includes a mount section, the first biasing section comprises a frustoconical coil spring, and a large-diameter section of the coil spring is in contact with the base section, and a small-diameter section of the coil spring is in contact with the mount section.

11. An image forming apparatus for forming an image on a sheet, comprising:

the charging device according to claim 1; and the image bearing member.

* * * * *